US005314568A

United States Patent [19]

Ryan

[11] Patent Number: 5,314,568

[45] Date of Patent: May 24, 1994

[54] SPLICE ASSEMBLY FOR PAPER WEB TRANSPORT APPARATUS

[75] Inventor: Ralph L. Ryan, East Hanover, N.J.

[73] Assignee: Compensating Tension Controls, Inc., West Caldwell, N.J.

[21] Appl. No.: 85,744

[22] Filed: Jun. 30, 1993

[51] Int. Cl.[5] ..... B65H 21/00

[52] U.S. Cl. ..... 156/504; 156/505; 156/159; 156/304.1; 242/58.4; 242/58.5

[58] Field of Search ..... 156/159, 304.1, 504, 156/505; 242/58.3, 58.4, 58.5

[56] References Cited

U.S. PATENT DOCUMENTS

| | | | |
|---|---|---|---|
| 3,858,819 | 1/1975 | Butler, Jr. | 156/504 X |
| 3,939,032 | 2/1976 | Taitel et al. | 156/505 |
| 4,190,483 | 2/1980 | Ryan et al. | 156/504 |
| 4,492,609 | 1/1985 | Blom | 156/507 |
| 4,526,638 | 7/1985 | Clements | 156/159 |
| 4,566,922 | 1/1986 | Martinez | 156/505 X |
| 4,645,554 | 2/1987 | Wyser | 156/159 |
| 4,801,342 | 1/1989 | Wheeler et al. | 156/159 |
| 4,856,960 | 8/1989 | Wheeler et al. | 242/586 X |
| 4,878,982 | 11/1989 | Ogata et al. | 156/505 X |
| 4,892,611 | 1/1990 | Wheeler et al. | 156/504 |
| 4,923,546 | 5/1990 | Wheeler et al. | 156/159 |

*Primary Examiner*—David A. Simmons
*Assistant Examiner*—Mark A. Osele
*Attorney, Agent, or Firm*—Richard M. Goldberg

[57] ABSTRACT

A splice assembly for a paper web transport apparatus including first and second webs of paper with each web alternately constituting a running web moving in first direction and a new web to be spliced to the running web, the splice assembly including a knife guide for providing a cutting edge for cutting the running web and the new web; a moving assembly for moving the knife guide back and forth in a direction of movement of the running web; first and second clamping assemblies for selectively clamping the running and new web, the first and second clamping assemblies being positioned on opposite sides of the knife guide in the direction of movement of the running web; two knives for selectively cutting the running web and the new web against the knife guide; a first tape applicator for applying a piece of tape to the same side of a splice of the running web and the new web, regardless of which of the first and second webs is the running web and which of the first and second webs is the new web, without indexing rolls of the first and second webs; and a tape backing assembly for providing a backing pressure for the tape applicator such that the cut running web and the cut new web are sandwiched between the tape backing assembly and the tape applicator and the piece of tape is applied to the splice during the sandwiching operation.

16 Claims, 4 Drawing Sheets

SPLICE ASSEMBLY FOR PAPER WEB TRANSPORT APPARATUS

BACKGROUND OF THE INVENTION

The present invention relates generally to web splicing assemblies, and more particularly, is directed to a butt splice assembly for a paper web transport apparatus.

In known paper web transport apparatus, there are two rolls of paper that are provided. When one roll nears depletion, the other roll is spliced therewith, so that a continuous web is always produced from the machine. It is known to produce two different types of splicing, namely butt splicing in which the spliced webs are butted up against each other and lap splicing in which the spliced webs overlap each other at the spliced position. Lap splicing is generally less expensive than butt splicing, and therefore, lap splicing is mostly used. However, in some circumstances, it is required to use butt splicing.

In either case, in some situations, it is important to keep the splicing tape on the same side of the continuous web at all times. For this reason, the two rolls are conventionally mounted on two spindles of an indexing mechanism. When one spindle contains the new web to be spliced, the indexing mechanism is in a first position, but when the other spindle contains the new web to be spliced, the indexing mechanism rotates 180° from the first position. This indexing mechanism therefore becomes rather cumbersome to use, particularly when using webs weighing thousands of pounds that have to be rotated and/or having large diameters.

U.S. Pat. Nos. 4,801,342; 4,856,960; 4,892,611; and 4,923,546, all to Wheeler et al, provide arrangements in which the tape is applied to both sides of a butt splice. When the web from the first roll is the running web, the tape is applied first to a first side of the cut portion of the new web. After adherence of the first side of the cut running web thereto, the tape is applied to the second side of the splice by a vacuum roll.

On the other hand, when the web from the second roll is the running web, the tape is applied first to the second side of the cut portion of the new web, that is, opposite to the aforementioned situation. After adherence of the second side of the cut running web thereto, the tape is applied to the first side of the splice by a vacuum roll.

Accordingly, the tape sections are alternately applied to opposite sides of the web. This is fine in the case where the tape is applied to both sides of the web. However, if the tape is to be applied only to one side of the splice, the tape would be applied alternately on opposite sides of the splice.

Further, in the above patents, the anvil against which the cuts are made and which functions as a pressure backing, is stationary.

U.S. Pat. No. 3,939,032 to Taitel et al and U.S. Pat. No. 4,190,483 to Ryan et al, both having a common assignee herewith, also disclose arrangements in which tape is applied to both sides of the splice in alternating fashion.

U.S. Pat. No. 4,492,609 to Blom discloses a very different arrangement with tape-applying cylinders positioned on opposite sides of the web, and which also provides an indexing mechanism for the web rolls.

U.S. Pat. No. 4,526,638 to Clements discloses an arrangement that also uses a turret or indexing mechanism for the rolls. The splicing assembly includes jaws, each of which carries a splicing head.

Finally, U.S. Pat. No. 4,645,554 to Wyser discloses a device that is concerned directly with the application of an adhesive strip that is always applied to the same face of the webs. However, two anvils associated with suction devices for each web are provided, and neither anvil is reciprocable. Rather, the anvils are stationary. Accordingly, a relatively complicated assembly is provided.

OBJECTS AND SUMMARY OF THE INVENTION

Accordingly, it is an object of the present invention to provide a butt splice assembly for a paper web transport apparatus that overcomes the problems with the aforementioned prior art.

It is another object of the present invention to provide a butt splice assembly for a paper web transport apparatus in which the tape is applied on the same side of the splice at all times.

It is still another object of the present invention to provide a butt splice assembly for a paper web transport apparatus which dispenses with the need for an indexing mechanism to support the rolls, while still ensuring that the tape is applied on the same side of the splice at all times.

In accordance with an aspect of the present invention, a splice assembly is provided for a paper web transport apparatus of the type including first and second webs of paper with each web alternately constituting a running web moving in first direction and a new web to be spliced to the running web upon depletion of the running web from a roll. The splice assembly includes a knife guide for providing a cutting edge for cutting the running web and the new web; a moving assembly for moving the knife guide back and forth in a direction of movement of the running web; a first clamping assembly for selectively clamping the running web and the new web, the first clamping assembly being positioned on one side of the knife guide in the direction of movement of the running web; a second clamping assembly for clamping the running web, the second clamping assembly being positioned on an opposite side of the knife guide from the first clamping assembly in the direction of movement of the running web; two knives for selectively cutting the running web and the new web against the knife guide; a first tape applicator for applying a piece of tape to the same side of a splice of the running web and the new web, regardless of which of the first and second webs is the running web and which of the first and second webs is the new web, without indexing rolls of the first and second webs; and a tape backing assembly for providing a backing pressure for the tape applicator such that the cut running web and the cut new web are sandwiched between the tape backing assembly and the tape applicator and the piece of tape is applied to the splice during the sandwiching operation.

Specifically, the knife guide includes a lower metal knife edge against which the knife cuts the running web and the new web. Further, the knife guide includes opposite ends, and the moving assembly includes a piston-cylinder assembly for moving the knife guide back and forth in the direction of movement of the running web, the piston-cylinder assembly including a piston rod connected with at least one end of the knife guide and a cylinder for extending and retracting each piston rod to move the knife guide back and forth in the direction of movement of the running web. The moving assembly further includes a movement guide assembly for guiding the knife guide back and forth in the direction of movement of the running web, the movement guide assembly including first and second stationary guide rods positioned on opposite sides of the knife guide, and a support connected with opposite sides of the knife guide and slidable along the guide rods for guiding the knife guide back and forth in the direction of movement of the running web.

The first clamping assembly includes a stationary cross bar positioned in alignment with the vertical knife guide, a first clamp for clamping the first web against one side of the stationary cross bar and a second clamp for clamping the second web against an opposite side of the stationary cross bar. Each of the first and second clamps includes a clamp bar and a pressure assembly connected with the clamp bar for moving the clamp bar into and out of pressure contact with the stationary cross bar to clamp the first and/or second web therebetween.

The second clamping assembly includes first and second clamp bars and a piston-cylinder assembly connected with each clamp bar for moving the clamp bars into pressure contact with each other to clamp the first or second web therebetween. In addition, a shifting assembly is provided for shifting the second clamping assembly so that a center line between the first and second clamp bars is in alignment with the first or second web.

There are two circular knives positioned on opposite sides of the vertical knife guide, each circular knife being positioned to cut a respective web against the vertical knife guide, and a moving assembly associated with each circular knife for moving the circular knife in a direction along the vertical knife guide. In addition, there is a guide roller associated with each circular knife for pressing the respective web against the vertical knife guide when the respective circular knife cuts the web.

The tape applicator includes a vacuum housing for holding the piece of tape thereon by vacuum pressure, with the tape having an outwardly facing adhesive surface, and a reciprocable assembly for moving the vacuum housing into and out of pressure contact with the tape backing assembly so as to sandwich the cut running web and the cut new web between the tape backing assembly and the tape applicator with the piece of tape being applied to the splice during the sandwiching operation. The reciprocable assembly includes a piston rod having a free end connected with the vacuum housing and a cylinder for extending the piston rod toward and away from the backing assembly. The tape applicator further includes a rotation assembly for rotating the reciprocable assembly and the vacuum housing toward and away from the backing assembly.

Finally, the backing assembly can include a second tape applicator comprised of vacuum housing for holding a piece of tape thereon by vacuum pressure, with the tape having an outwardly facing adhesive surface, and a reciprocable assembly for moving the vacuum housing into and out of pressure contact with the first-mentioned tape applicator so as to sandwich the cut running web and the cut new web between the first-mentioned and the second tape applicator with the piece of tape being applied to both sides of the splice during the sandwiching operation. The reciprocable assembly includes a piston rod having a free end connected with the vacuum housing and a cylinder for extending the piston rod toward and away from the first-mentioned tape applicator. The second tape applicator further includes a rotation assembly for rotating the reciprocable assembly and the vacuum housing toward and away from the first-mentioned tape applicator.

The above and other objects, features and advantages of the invention will become readily apparent from the following detailed description thereof which is to be read in connection with the accompanying drawings.

DETAILED DESCRIPTION OF A PREFERRED EMBODIMENT

Figure 1:
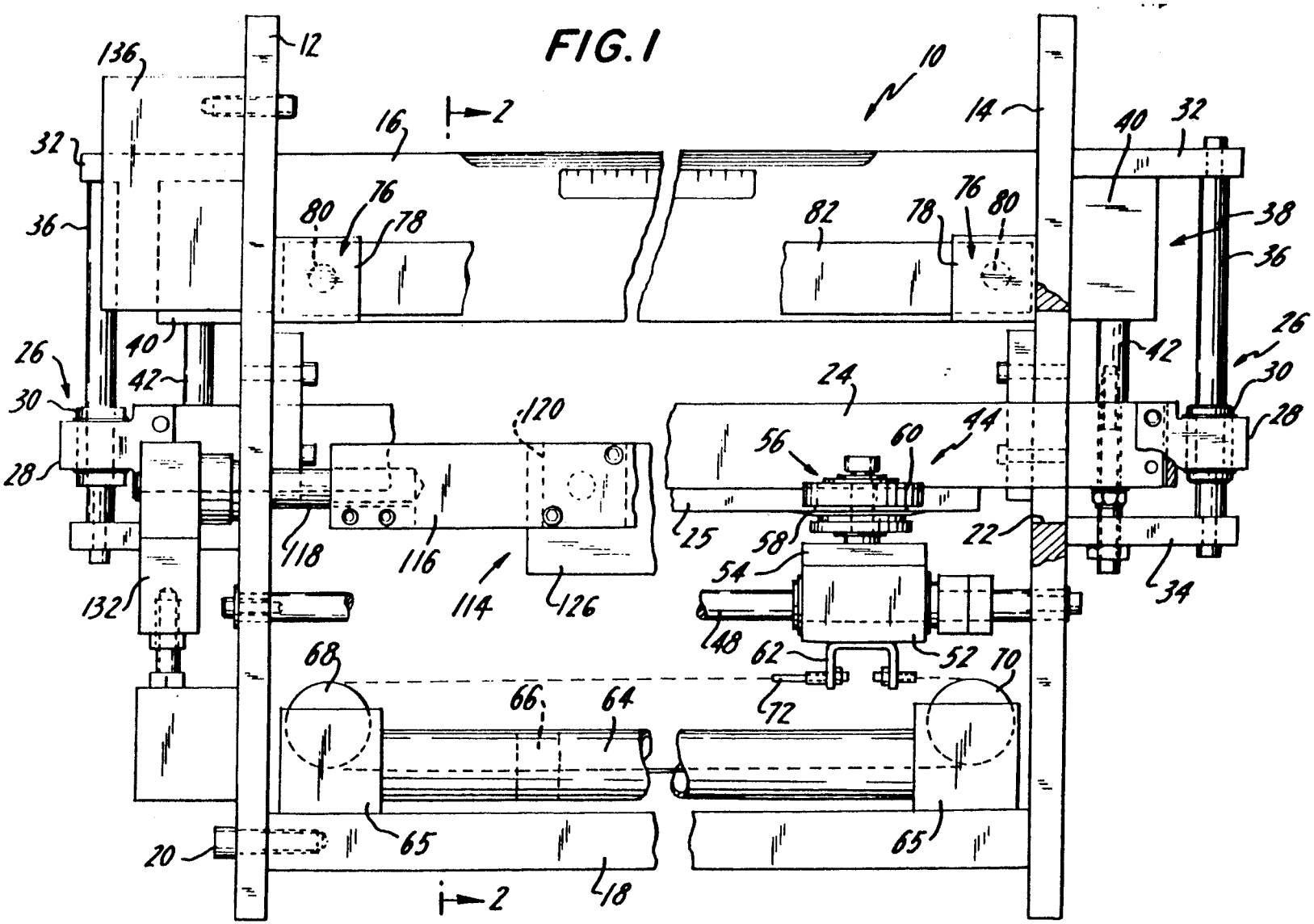
FIG. 1 is a side elevational view of a butt splice assembly for a paper web transport apparatus according to the present invention.

As will now be described in detail, the present invention provides an arrangement which does not require the use of an indexing mechanism to position the splicing tape on the same side of splicing attachments of a web which has been continuously formed by splicing the leading end of a new web with the trailing end of a running web.

Thus, referring to the drawings in detail, a butt splice assembly 10 for a paper web transport apparatus includes a vertically oriented rear mounting plate 12 and a parallel, spaced apart front mounting plate 14. An upper, vertically elongated cross bar 16 extends between rear mounting plate 12 and front mounting plate 14, and includes opposite, parallel faces **16*a* and 16*b*. In like manner, two lower cross bars 18 extend between rear mounting plate 12 and front mounting plate 14 at opposite sides of assembly 10. Such mounting can, for example, be made by bolts 20 or the like. Further, each mounting plate 12 and 14 includes a vertically oriented elongated slot 22, which is substantially centrally located therein, and with slots 22 being in alignment with each other. Each slot 22 is in alignment with the cross bar 16** and is positioned therebelow.

In accordance with an important aspect of the present invention, a vertical knife guide 24 is positioned substantially centrally of assembly 10 between rear mounting plate 12 and front mounting plate 14. Vertical knife guide 24 has a lower metal knife edge 25. Opposite ends of vertical knife guide 24 extend through slots 22 and are connected to reciprocating assemblies 26 located to the outside of each mounting plate 12 and 14, for moving vertical knife guide 24 up and down in the vertical direction.

Specifically, each reciprocating assembly 26 includes a knife guide support 28 connected to and extending outwardly from each end of vertical knife guide 24, each knife guide support 28 having an internal linear bearing 30. An upper support 32 and a lower support 34 are provided in parallel, vertically spaced relation in FIG. 1 and are connected to the external surfaces of each of rear and front mounting plates 12 and 14. A guide rod 36 is connected between the free ends of upper and lower supports 32 and 34 at opposite sides of assembly 10, with one internal linear bearing 30 slidably mounted on each guide rod 36. Accordingly, vertical knife guide 24 can move up and down.

In order to control movement of vertical knife guide 24, a piston-cylinder arrangement 38 is provided at the front and rear of assembly 10. Specifically, piston-cylinder arrangement 38 includes a cylinder 40 connected to the external surface of each of rear and front mounting plates 12 and 14 and to the underside of each upper support 32. Each cylinder 40 has a reciprocable piston rod 42 which is connected with a respective free end of vertical knife guide 24. Accordingly, retraction of piston rods 42 results in vertical knife guide 24 moving upwardly in the direction of FIG. 1, and guided along guide rods 36.

Figure 2:
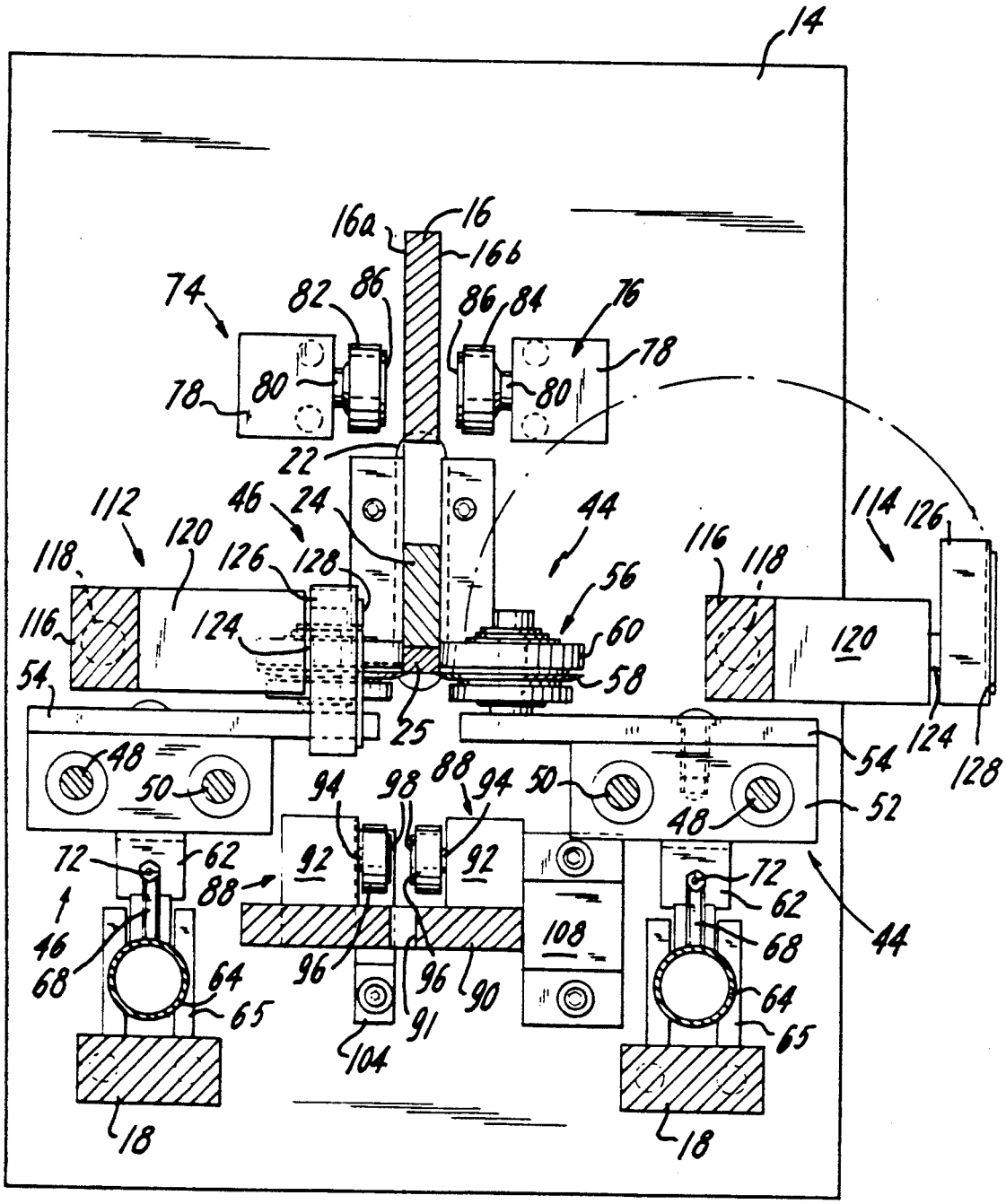
FIG. 2 is a cross-sectional view of the butt splice assembly of FIG. 1, taken along line 2—2 thereof.
Figure 3:
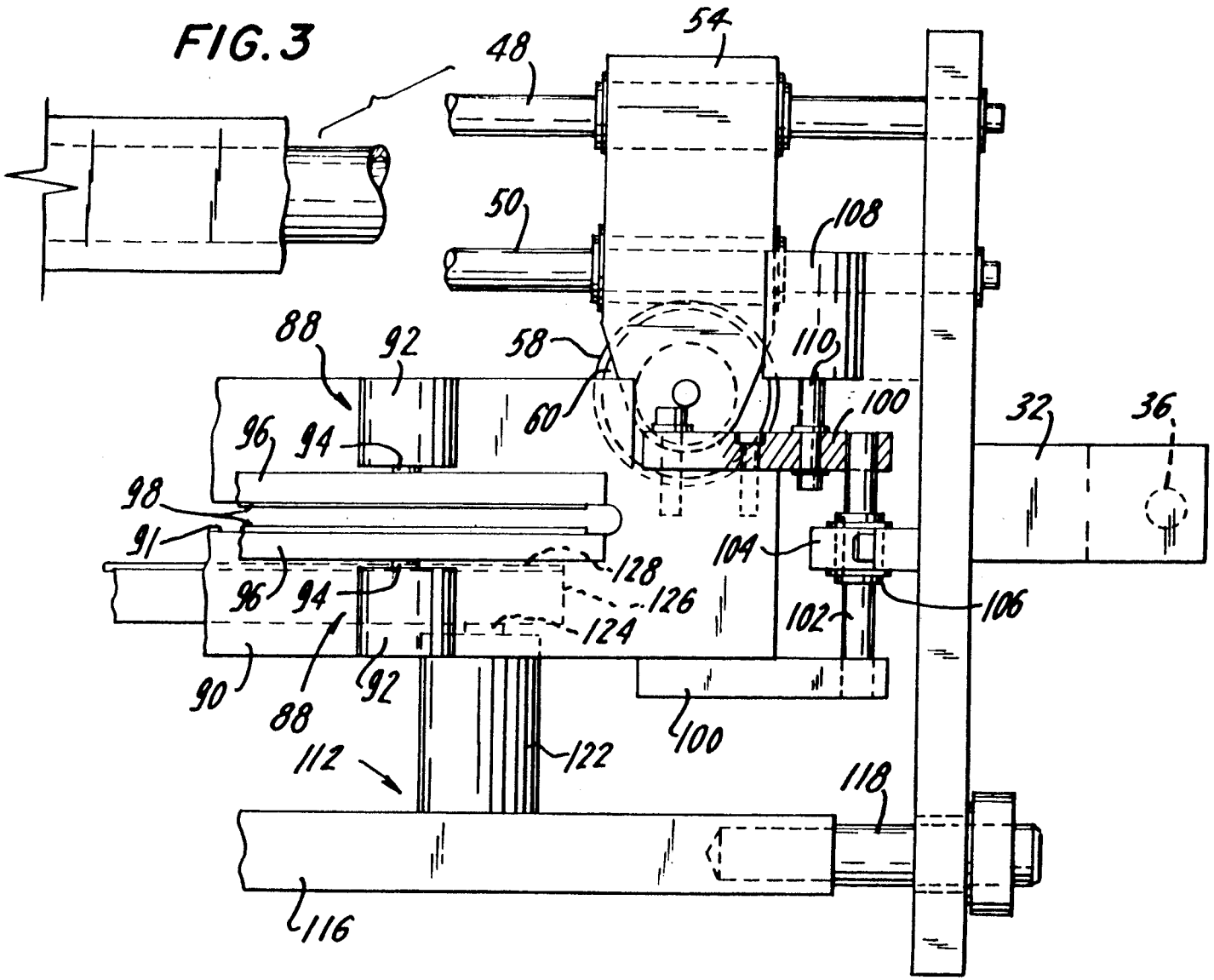
FIG. 3 is a top plan view of a portion of the butt splice assembly of FIG. 1.

A flying knife assembly 44 is provided on one side (the right side of FIG. 2) of vertical knife guide 24 for cutting a web of paper along lower metal knife edge 25, and a flying knife assembly 46 is provided on the other side (the left side of FIG. 2) of vertical knife guide 24 for cutting a web of paper along lower metal knife edge 25. Each flying knife assembly 44 and 46 includes first and second guide rods 48 and 50 that are connected between rear and front mounting plates 12 and 14. First and second guide rods 48 and 50 of each set are in parallel, spaced relation in the same horizontal plane, as shown in FIG. 2. A bearing housing 52 is slidably mounted on each set of first and second guide rods 48 and 50, with a knife holding plate 54 mounted on the upper surface of bearing housing 52.

A circular knife assembly 56 is mounted on the upper surface of each knife holding plate 54 and includes a circular knife 58 and a coaxial guide roller 60. Each guide roller 60 rides along a respective side of vertical knife guide 24. At the same time, circular knife 58 is aligned with the bottom of lower metal knife edge 25 in order to cut paper from a web thereagainst, as best shown in FIG. 2.

In order to move circular knife 58 along the paper to be cut, a U-shaped bracket 62 is mounted to the underside of each bearing housing 52. Further, a rodless air cylinder 64 extends between rear and front mounting plates 12 and 14 and includes a piston 66 therein, as is conventional. Specifically, each rodless air cylinder 64 is mounted by a mounting assembly 65 on one lower cross bar 18. Piston 66 is moved back and forth between the front and rear of assembly 10 in a known manner. Pulleys 68 and 70 are rotatably mounted at opposite ends of rodless air cylinder 64, and an endless cable 72 is provided about pulleys 68 and 70. Endless cable 72 is connected with piston 66 and bracket 62. Accordingly, as piston 66 moves back and forth within rodless air cylinder 64, the respective bearing housing 52, and thereby circular knife 58 associated therewith, are moved along first and second guide rods 48 and 50. In this manner, the moving circular knife 58 will cut any paper from a web against lower metal knife edge 25.

In order to ensure that paper from a web is held stationary during the cutting operation, butt splice assembly 10 further includes various clamping assemblies. Specifically, one upper clamp 74 is mounted on one side (the left side of FIG. 2) of upper cross bar 16 in opposition to face **16*a* thereof and one upper clamp 76 is mounted on the other side (the right side of FIG. 2) of upper cross bar 16 in opposition to face 16*b* thereof. Each upper clamp 74 and 76 includes a cylinder 78 mounted to the inner face of the respective rear and front mounting plates 12 and 14, with each cylinder 78 including a reciprocable piston rod 80. A clamp bar 82 is secured to the free ends of the piston rods 80 of upper clamps 74, while a clamp bar 84 is secured to the free ends of the piston rods 80 of upper clamps 76. A strip 86 of silicone rubber is secured to the inner face of each clamp bar 82 and 84**.

Thus, a web of paper travelling between upper cross bar 16 and upper clamp 74 can be clamped between face **16*a* of upper cross bar 16 and clamp bar 82 by extension of the respective pistons 80 of upper clamp 74, while a web of paper travelling between upper cross bar 16 and upper clamp 76 can be clamped between face 16*b* of upper cross bar 16 and clamp bar 84 by extension of the respective pistons 80 of upper clamp 76**.

Further, butt splice assembly 10 includes two centrally located and opposite facing lower clamps 88 mounted on a cylinder base 90 having a slot 91 through which passage of a web of paper occurs. Each lower clamp 88 includes a cylinder 92 mounted on cylinder base 90 and a piston rod 94 extending toward the other lower clamp 88. A clamp bar 96 is provided on the free end of each piston rod 94, with a strip 98 of silicone rubber secured to the inner face of each clamp bar 96. Thus, when piston rods 94 are moved toward each other, clamp bars 96 can clamp a web of paper travelling therebetween.

It will be appreciated that the center line between lower clamps 88 is shown in FIG. 2 in alignment for receiving a web of paper that would extend to the left of vertical knife guide 24 in FIG. 2. Accordingly, if the web of paper to be clamped extends to the right of vertical knife guide 24 in FIG. 2, it is necessary to move lower clamps 88 to the right in FIG. 2 so as to be in alignment therewith. In this regard, at each end of cylinder base 90, there are two parallel and spaced cylinder end blocks 100 secured to the opposite edges of cylinder base 90 and having portions thereof extending toward the respective rear or front mounting plate 12 or 14. The portions are secured together by a guide shaft 102 that is slidably retained by a holder 104 having a linear bearing 106 therein. Holder 104 is secured to the inner surface of the respective rear or front mounting plate 12 or 14. Thus, cylinder base 90 supports lower clamps 88, and guide shafts 102 support opposite ends of cylinder base 90 through cylinder end blocks 100. It will be appreciated that cylinder base 90 is therefore reciprocable relative to holders 104.

In order to control movement of cylinder base 90 a cylinder 108 is mounted to the inner surface of front mounting plate 14 and has a reciprocable piston rod 110 with the free end thereof connected with one cylinder end block 100. As a result, movement of piston rod 110 results in movement of cylinder base 90 shafts 102, and thereby, movement of lower clamps 88 in unison by the same amount. Thus, the center line between lower clamps 88 can be moved into alignment with a web of paper on either side of vertical knife guide 24.

Butt splice assembly 10 further includes two tape applicator assemblies 112 and 114 positioned on opposite sides of vertical knife guide 24. Each tape applicator assembly 112 and 114 includes a cylinder mounting bar 116 extending between rear and front mounting plates 12 and 14, and rotatably mounted thereto by means of end shafts 118. A front cylinder 120 adjacent front mounting plate 14 and a rear cylinder 122 adjacent rear mounting plate 12 are mounted to cylinder mounting bar 116, each cylinder 120 and 122 having a reciprocable piston rod 124. An elongated vacuum housing 126 is mounted to the free ends of piston rods 124, and has a rubber backed plate 128 secured to the opposite surface thereto. Rubber backed plate 128 provides small holes (not shown) for communication with vacuum housing 126. In this manner, a piece of tape (not shown) can be held to rubber backed plate 128 with the adhesive side out. Of course, it will be appreciated that a vacuum control assembly (not shown) is connected with vacuum housings 126. Thus, when a vacuum is applied, tape can be held thereto, and will be released when the vacuum is released.

Figure 4:
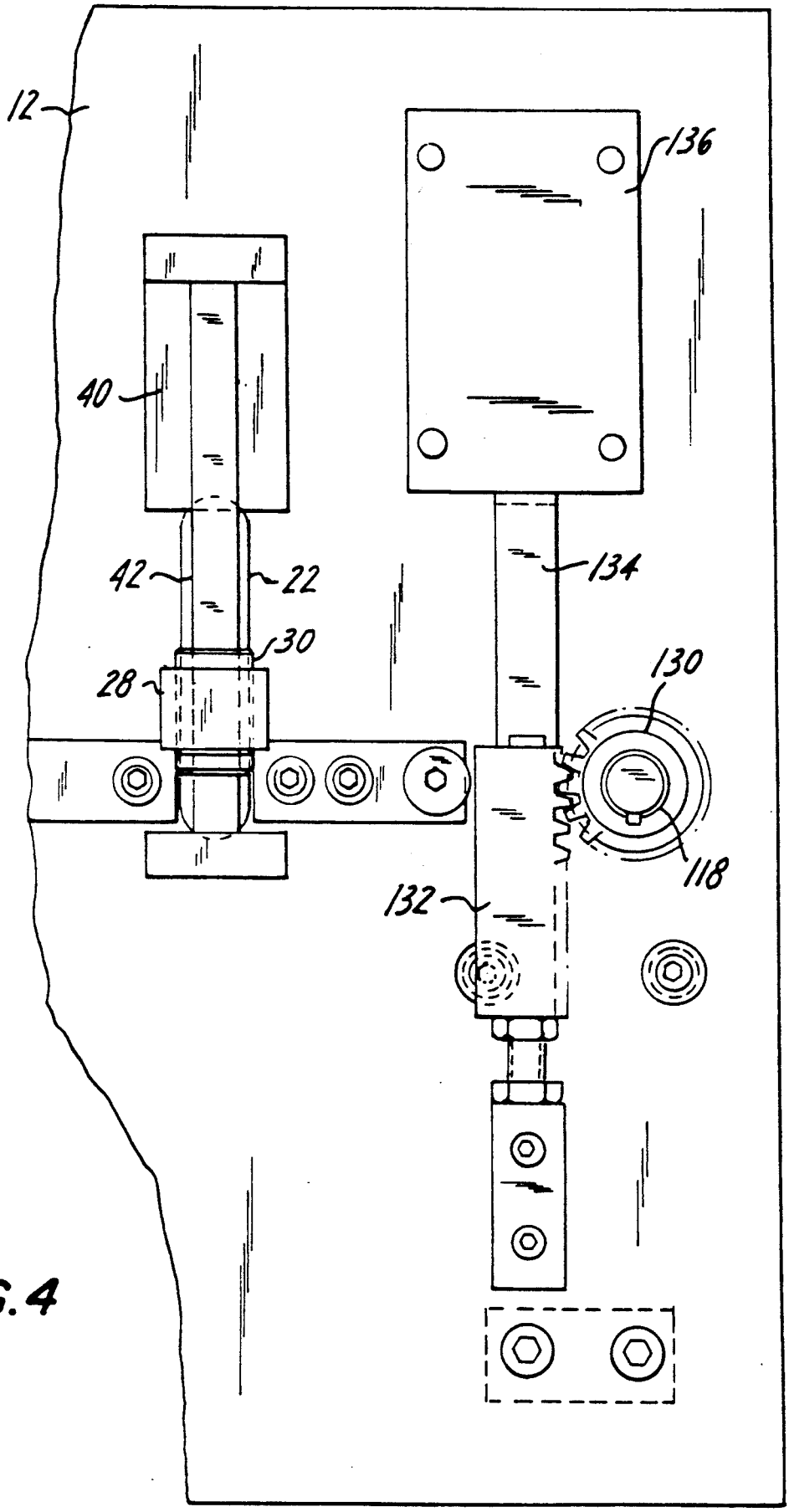
FIG. 4 is a rear elevational view of a portion of the butt splice assembly of FIG. 1.

As shown in FIG. 4, one end shaft 118 that extends from rear mounting plate 12 has a gear 130 thereon which meshes with a rack 132. Rack 132 is mounted to the free end of a piston rod 134 that is reciprocally controlled by a cylinder 136 mounted to the external surface of rear mounting plate 12. In this manner, vacuum housings 126 can be rotated 180° from the position shown in FIG. 2 by vacuum housing 126 of tape applicator assembly 112 to the position shown by vacuum housing 126 of tape applicator assembly 114. In the position shown by tape applicator assembly 112 in FIG. 2, piston rod 124 can be extended to apply tape thereon to a web of paper that has been cut and which is held between upper clamps 74 or 76, and upper cross bar 16.

In operation, and referring to FIG. 2, assume first that a running web runs freely between upper clamp 76 and upper cross bar 16. From this point, the running web continues to a position to the right side of vertical knife guide 24, and then to a position between lower clamps 88. It will be appreciated that the center line between lower clamps 88 is moved into alignment with the running web, that is, to a position to the right shown in FIG. 2. Thereafter, the running web continues through other parts of the machinery, such as a festoon assembly (not shown), a printing press (not shown) and the like.

While the running web is running through the aforementioned route, the leading edge of a new web is positioned between upper clamp 74 and the opposite left side of upper cross bar 16, and then to a position on the opposite left side of vertical knife guide 24, as viewed in FIG. 2, with the leading edge of the new web hanging below lower metal knife edge 25 of vertical knife guide 24. At this time, both tape applicator assemblies 112 and 114 are positioned outwardly away from vertical knife guide 24, that is, in the position shown by tape applicator assembly 114 in FIG. 2.

Then, with the webs in the above positions, upper clamp 74 clamps the new web, and circular knife 58 of flying knife assembly 46 cuts the leading edge of the new web against lower metal knife edge 25 so that it is even with lower metal knife edge 25 of vertical knife guide 24. In other words, circular knife 58 is moved along the length of the new web by bearing housing 52. It will be appreciated that, during this cutting operation, guide roller 60 presses the new web against vertical knife guide 24.

After the new web has been cut, as aforementioned, a piece of tape (not shown) equal to the width of the new web is applied across vacuum housing 126 of tape applicator assembly 112 with its adhesive side out, and held there by vacuum pressure. Then, tape applicator assembly 112 is rotated 180° to the position shown in FIG. 2, and piston rod 124 thereof is extended so that elongated vacuum housing 126 sandwiches the tape and cut leading edge of the new web between it and vertical knife guide 24. In such position, the upper half of the tape is stuck to the cut leading edge of the new web, with the lower half of the tape extending down below the cut leading edge of the new web and below lower metal knife plate 25.

Butt splice assembly 10 is now ready for the situation when the running web roll nears depletion. At such time, the running web roll is braked, the running web is then clamped at its upper end between upper clamp 76 and surface **16*b* of upper cross bar 16, and is then clamped at its lower end between lower clamps 88. Thereafter, circular knife 58 of flying knife assembly 44 cuts the leading edge of the running web against lower metal knife edge 25 so that it is even with lower metal knife edge 25 of vertical knife guide 24. In other words, circular knife 58 is moved along the length of the running web by bearing housing 52. It will be appreciated that, during this cutting operation, guide roller 60 presses the running web against vertical knife guide 24**. A roller or the like (not shown) pulls the upper part of the running web (which is still attached to the supply roll) away. In other words, only the lower part of the running web remains. Since the web has sufficient rigidity, it does not flop over.

In accordance with an extremely important aspect of the present invention, vertical knife guide 24 is then raised up, and tape applicator assembly 114 is rotated 180° from the position shown in FIG. 2. Thereafter, piston rod 124 of tape applicator assembly 114 is extended so as to move vacuum housing 126 of tape applicator assembly 114 into pressing engagement with vacuum housing 126 of tape applicator assembly 112. At the same time, lower clamps 88 are moved to a central position, and after the splice is made, continues moving to the opposite side. This results in the cut upper edge of the running web being pressed into abutting relation with the cut lower edge of the new web, and with the tape that is overhanging the new web being pressed into engagement with the cut upper edge of the running web. As such, a perfect butt splice is attained, with the tape being adhered on the left side of the splice, as viewed in FIG. 2. Thereafter, the new web becomes the running web.

Then, a new roll replaces the depleted roll of the former running web which is still positioned to the right of vertical knife guide 24, as viewed in FIG. 2. Further, vertical knife guide 24 is lowered again to its original position. Also, with the running web now positioned to the left side of vertical knife guide 24, lower clamps 88 have been shifted to the left to the position shown in FIG. 2 so that the center line therebetween is in alignment with the new running web.

At this time, the leading edge of the new web on the right side of vertical knife guide 24 is brought down and cut. Specifically, while the running web is running through the aforementioned route of upper clamp 74 and upper cross bar 16, and to the left of vertical knife guide 24, the leading edge of the new web is positioned between upper clamp 76 and the opposite right side of upper cross bar 16, as viewed in FIG. 2, and then to a position on the right side of vertical knife guide 24, with the leading edge hanging down below lower metal knife edge 25 of vertical knife guide 24. At this time, both tape applicator assemblies 112 and 114 are positioned outwardly away from vertical knife guide 24, that is, in the position shown by tape applicator assembly 114 in FIG. 2.

Then, with the webs in the above positions, upper clamp 76 clamps the new web against surface **16*b* of upper cross bar 16, and circular knife 58 of flying knife assembly 44 cuts the leading edge of the new web against lower metal knife edge 25 so that it is even with lower metal knife edge 25 of vertical knife guide 24. In other words, circular knife 58 is moved along the length of the new web by bearing housing 52. It will be appreciated that, during this cutting operation, guide roller 60 presses the new web against vertical knife guide 24. At this time, however, no tape is applied to the cut new web. However, after the new web has been cut, as aforementioned, a piece of tape (not shown) equal to the width of the new web is applied across vacuum housing 126 of the same tape applicator 112 as before, with its adhesive side out, and held there by vacuum pressure. Thus, the tape is held to the same left side of vertical knife guide 24**.

Butt splice assembly 10 is now ready for the situation when the running web roll (now positioned to the left of vertical knife guide 24) nears depletion. At such time, the running web roll is braked, the running web is then clamped at its upper end between upper clamp 74 and surface 16*a* of upper cross bar 16, and is then clamped at its lower end between lower clamps 88, which are in the position shown in FIG. 2. Thereafter, circular knife 58 of flying knife assembly 46 cuts the leading edge of the running web against the left side of lower metal knife edge 25 so that it is even with lower metal knife edge 25 of vertical knife guide 24. In other words, circular knife 58 is moved along the length of the running web by bearing housing 52. It will be appreciated that, during this cutting operation, guide roller 60 presses the new web against vertical knife guide 24. A roller or the like (not shown) pulls the upper part of the running web (which is still attached to the supply roll) away. In other words, only the lower part of the running web remains.

In accordance with the aforementioned extremely important aspect of the present invention, vertical knife guide 24 is once again raised up. At this time, tape applicator assemblies 112 and 114 are both rotated 180° to the inwardly directed positions, that is, to the position shown by tape applicator assembly 112 in FIG. 2.

Thereafter, tape applicator assemblies 112 and 114 are moved into pressing engagement with each other. At the same time, lower clamps 88 are moved to a central position, and after the splice is made, continues moving to the opposite side. This results in the cut upper edge of the running web being pressed into abutting relation with the cut lower edge of the new web. Further, the tape on tape applicator assembly 112 is pressed with its upper half onto the new web and its lower half onto the running web. As such, a butt splice is attained, and the new web becomes the running web.

It will be appreciated that the present invention provides for the application of tape on the same side of the running web at all times, without the need for using an indexing mechanism to support the rolls, regardless of which web is the running web. This is a result of the vertically reciprocable vertical knife guide.

Although the present invention has been discussed with respect to a butt splicing assembly, it will be appreciated that the present invention could just as easily be used to provide a lap splice. Further, although the present invention has been discussed with the application of tape to only one side of the splice, tape could easily be applied to both sides of the splice. This would be accomplished by applying tape to both tape applicator assemblies 112 and 114.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A splice assembly for a paper web transport apparatus of the type including first and second webs of paper with each said web alternately constituting a running web moving in first direction and a new web to be spliced to the running web upon depletion of the running web from a roll, the splice assembly comprising:

knife guide means for providing a cutting edge for cutting said running web and said new web;

moving means for moving said knife guide means back and forth in a direction of movement of said running web;

first clamping means for selectively clamping said running web and said new web, said first clamping means being positioned on one side of said knife guide means in the direction of movement of said running web;

second clamping means for clamping said running web, said second clamping means being positioned on an opposite side of said knife guide means from the first clamping means in the direction of movement of said running web;

knife means for selectively cutting said running web and said new web against said knife guide means;

tape applicator means for applying a piece of tape to the same side of a splice of the running web and the new web, regardless of which of said first and second webs is the running web and which of said first and second webs is the new web, without indexing rolls of said first and second webs; and tape backing means for providing a backing pressure for said tape applicator means such that the cut running web and the cut new web are sandwiched between said tape backing means and said tape applicator means and said piece of tape is applied to said splice during the sandwiching operation.

2. A splice assembly according to claim 1, wherein said knife guide means includes a lower metal knife edge against which said knife means cuts said running web and said new web.

3. A splice assembly according to claim 1, wherein said knife guide means includes opposite ends; and said moving means includes piston-cylinder means for moving said knife guide means back and forth in the direction of movement of said running web, said piston-cylinder means including a piston rod connected with at least one end of said knife guide means and cylinder means for extending and retracting each said piston rod to move said knife guide means back and forth in the direction of movement of said running web.

4. A splice assembly according to claim 3, wherein said moving means further includes movement guide means for guiding said knife guide means back and forth in the direction of movement of said running web, said movement guide means including first and second stationary guide rods positioned on opposite sides of said knife guide means, and support means connected with opposite sides of said knife guide means and slidable along said guide rods for guiding said knife guide means back and forth in the direction of movement of said running web.

5. A splice assembly according to claim 1, wherein said first clamping means includes a stationary cross bar positioned in alignment with said knife guide means, first clamp assembly means for clamping said first web against one side of said stationary cross bar and second clamp assembly means for clamping said second web against an opposite side of said stationary cross bar from the first clamp assembly means.

6. A splice assembly according to claim 5, wherein each of said first and second clamp assembly means includes a clamp bar and pressure means connected with said clamp bar for moving said clamp bar into and out of pressure contact with said stationary cross bar to clamp said first and/or second web therebetween.

7. A splice assembly according to claim 1, wherein said second clamping means includes first and second clamp bars and piston-cylinder means connected with said clamp bars for moving said clamp bars into pressure contact with each other to clamp either said first or second web therebetween.

8. A splice assembly according to claim 7, further including shifting means for shifting said second clamping means so that a center line between said first and second clamp bars is in alignment with said first or second web.

9. A splice assembly according to claim 1, wherein said knife means includes first and second circular knives positioned on opposite sides of said knife guide means, each circular knife being positioned to cut a respective web against said knife guide means, and moving means associated with each said circular knife for moving said circular knife in a direction along said knife guide means.

10. A splice assembly according to claim 9, wherein said knife means further includes guide roller means associated with each said circular knife for pressing the respective web against said knife guide means when the respective circular knife cuts the web.

11. A splice assembly according to claim 1, wherein said tape applicator means includes vacuum housing means for holding the piece of tape thereon by vacuum pressure, with the tape having an outwardly facing adhesive surface, and reciprocable means for moving said vacuum housing means into and out of pressure contact with said backing means so as to sandwich the cut running web and the cut new web between said tape backing means and said tape applicator means with said piece of tape being applied to said splice during the sandwiching operation.

12. A splice assembly according to claim 11, wherein said reciprocable means includes a piston rod having a free end connected with said vacuum housing means and cylinder means for extending said piston rod toward and away from said backing means.

13. A splice assembly according to claim 11, wherein said tape applicator means further includes rotation means for rotating said reciprocable means and said vacuum housing means toward and away from said backing means.

14. A splice assembly according to claim 1, wherein said backing means includes second tape applicator means comprised of vacuum housing means for holding a piece of tape thereon by vacuum pressure, with the tape having an outwardly facing adhesive surface, and reciprocable means for moving said vacuum housing means into and out of pressure contact with said first-mentioned tape applicator means so as to sandwich the cut running web and the cut new web between said first-mentioned and said second tape applicator means with said piece of tape being applied to both sides of said splice during the sandwiching operation.

15. A splice assembly according to claim 14, wherein said reciprocable means includes a piston rod having a free end connected with said vacuum housing means and cylinder means for extending said piston rod toward and away from said first-mentioned tape applicator means.

16. A splice assembly according to claim 14, wherein said second tape applicator means further includes rotation means for rotating said reciprocable means and said vacuum housing means toward and away from said first-mentioned tape applicator means.

* * * * *